United States Patent [19]

Jones, Jr. et al.

[11] 4,162,499

[45] Jul. 24, 1979

[54] FLUSH-MOUNTED PIGGYBACK MICROSTRIP ANTENNA

[75] Inventors: Howard S. Jones, Jr., Washington, D.C.; Frederick G. Farrar, Kensington; Daniel H. Schaubert, Silver Spring, both of Md.

[73] Assignee: The United States of America as represented by the Secretary of the Army, Washington, D.C.

[21] Appl. No.: 845,528

[22] Filed: Oct. 26, 1977

[51] Int. Cl.[2] ..... H01Q 1/38; H01Q 1/28

[52] U.S. Cl. ..... 343/700 MS; 343/708

[58] Field of Search ..... 343/700 MS, 829, 830, 343/846, 705, 708

[56] References Cited

U.S. PATENT DOCUMENTS

| | | | |
|---|---|---|---|
| 3,541,557 | 11/1970 | Miley | 343/700 MS |
| 4,067,016 | 1/1978 | Kaloi | 343/700 MS |
| 4,070,676 | 1/1978 | Sanford | 343/829 |

*Primary Examiner*—Eli Lieberman

*Attorney, Agent, or Firm*—Nathan Edelberg; Robert P. Gibson; Saul Elbaum

[57] ABSTRACT

A dual radiating system where one radiating element is placed atop the other in a piggyback fashion. The elements can be a pair of microstrip or dielectric-loaded parallel plate radiators, or it can be a combination of the two. Separate coaxial lines feed each of the radiators, and there is a minimum of coupling from one antenna to another. The antenna can be used alone or more effectively in a linear or planar conformal array.

10 Claims, 7 Drawing Figures

FLUSH-MOUNTED PIGGYBACK MICROSTRIP ANTENNA

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

The present invention is related to dual, flush mounted antenna systems and, more particularly, towards dual antennas which are mounted in a piggyback fashion.

2. Description of the Prior Art

Antennas are generally designed to perform a desired electrical function, for example, transmitting or receiving signals of a required bandwidth, direction, polarization, gain, or other relevant characteristics. But mechanical constraints such as size, weight, location, and profile can under many circumstances be the most important criteria. Where a dual antenna system is required, especially in the missile systems, aircraft, and various projectiles, these parameters become all the more critical.

Several antenna dual antenna systems have been proposed. U.S. Pat. No. 3,818,490 to Henry Leahy discloses a dual frequency antenna array. The array has two repetitive radiator systems in a single aperture which operate in two distinct frequency ranges. The first radiator system is made up of a plurality of rows of a certain type of radiator element interspersed between which are rows of the second kind of radiator element. Robert Pierrot in U.S. Pat. No. 3,864,690 incorporates into a radome a dual antenna system by utilizing a dielectric whose thickness is transparent to a first frequency and a network of wires integrated with the dielectric designed to be transparent with a second frequency.

Both of these systems have various shortcomings because each antenna in a system is necessarily designed to operate in a distinct frequency range. This not only limits the electrical flexibility, but also affects the mechanical parameters. The inventor, by using the properties of parallel plate and microstrip radiators can, operate a dual antenna system in a piggyback fashion without deletorious electrical affects and with much mechanical savings.

SUMMARY AND OBJECTS OF THE INVENTION

Accordingly, it is one object of this invention to provide an antenna system which permits the utilization of two or more antennas in close proximity capable of performing different functions.

It is another object of this invention to provide a unique antenna system which allows two antennas to share the same aperture and yet have good electrical isolation.

It is a further object of this invention to provide an antenna system which provides compactness, flush mounting, low profile, and conserves space and can be constructed as part of an existing structure.

It is still another object of this invention to eliminate the need for antennas inside of a radome for fuzing, guidance, telemetry, and other functions and provide a substantial reduction in overall weight.

It is still a further object of this invention to provide a basic radiating element which has good radiation characteristics and with properly designed feed networks can be used to provide a highly efficient and well controlled linear or planar array.

The foregoing and other objects of this invention are attained in accordance with one aspect of this invention through the provision of a dual antenna system with one antenna mounted atop the other. The system comprises two radiating surfaces over a ground plane, the radiators being either microstrip or parallel plate. Each antenna is separately fed by a coaxial line feed. The outer conductor of the feed to upper radiating element can short the lower element and act as an impedance matching device. The basic piggyback antenna can also be conveniently used as a dual frequency linear array.

BRIEF DESCRIPTION OF THE DRAWINGS

The above and further objects and novel features of the invention will more fully appear from the following description when the same is read in connection with the accompanying drawings in which.

DESCRIPTION OF THE PREFERRED EMBODIMENT OF THIS INVENTION

Figure 1A:
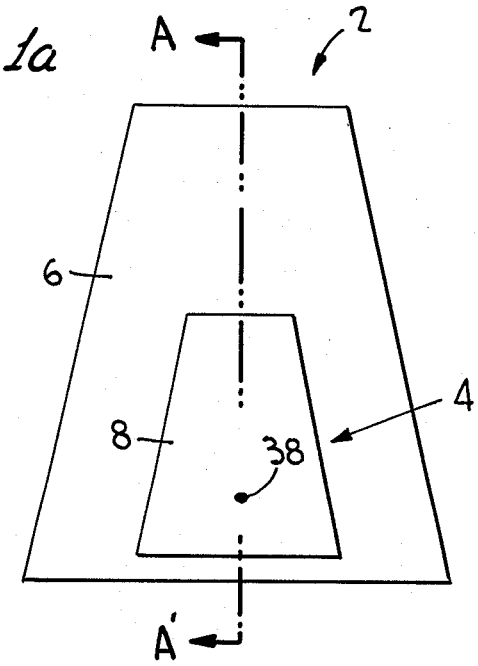
FIGS. 1*a* and 1*b* illustrate schematically a top view and cross sectional of the present invention illustrating another way of coupling the radiating elements to an rf source.
Figure 1B:
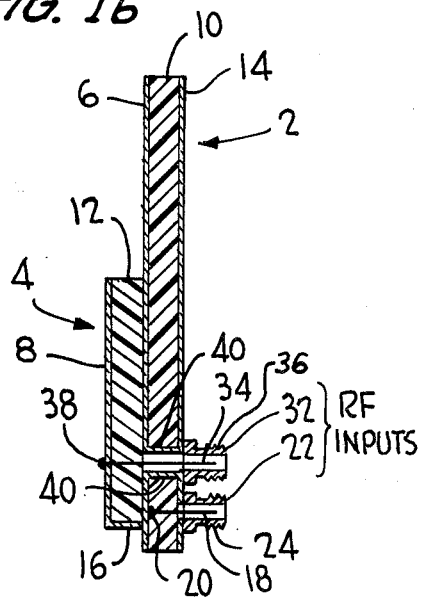

FIG. 1 illustrates schematically a flush mounted antenna system with one element mounted on top the other in a piggyback fashion. Large wedge shaped patch 2 in this figure is a microstrip radiator with smaller wedge shaped patch 4 being a parallel plate radiator. The types of radiators can be inverted or if one chooses they both can be of the same type. The length of microstrip radiator 6 is so chosen so that its length is approximately $\lambda/2$ at its operating frequency, and parallel plate radiator 8 is approximately $\lambda/4$ at its operating frequency. Each radiator, 2 and 4, is fabricated on low loss dielectric substrates 10 and 12 which, for example, may be of a teflon fiberglass material. When using the teflon material 1/16" was found to be a suitable thickness. Conductive plating such as copper is used to form radiating surfaces 6 and 8 and ground plane 14 which can be part of the body upon which the antenna is mounted. In the case of parallel plate radiator 4 in FIG. 1 the radiating element is short circuited at one end by conductive wall 16 which may also be copper clad. The radiating elements 6 and 8 are positioned atop one another in the manner illustrated because there are no measurable currents in the center of the patches. The dual antennas are fed from coaxial lines. As seen in FIG. 1*b* bottom (microstrip) radiator 2 has inner conductor 18 of coaxial line 22 feed through dielectric 10 and ground plane 14 and is electrically bound to outer conducting element 6 of radiator 4. The outer jacket of coax 22 is electrically bound to the other parallel wall 14 which acts as the ground plane. In the case of radiator 4 inner conductor 34 of coaxial line feed passes completely through radiator 2 and is electrically bound to the outer radiating element 8 of the parallel plate radiator. Outer jacket 36 of coaxial line feed 32 is electrically bound to ground plane 14. Furthermore, it is electrically shorted by conducting wall 40 to the lower conducting element of parallel plate 4 which is also radiating element 6 of radiator 2. Thus in addition to acting as the ground for antenna 4 it functions as an inductive post for antenna 2. It therefore serves as an impedance match to the microstrip radiator.

Figure 2A:
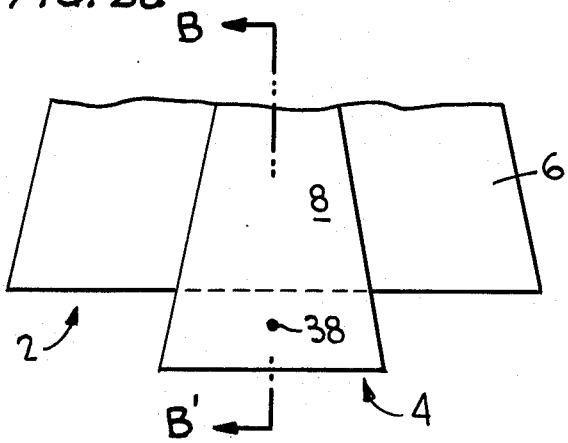
FIGS. 2*a* and 2*b* illustrate schematically a top view and cross sectional of the present invention illustrating another way of coupling the radiating elements to an rf source.
Figure 2B:
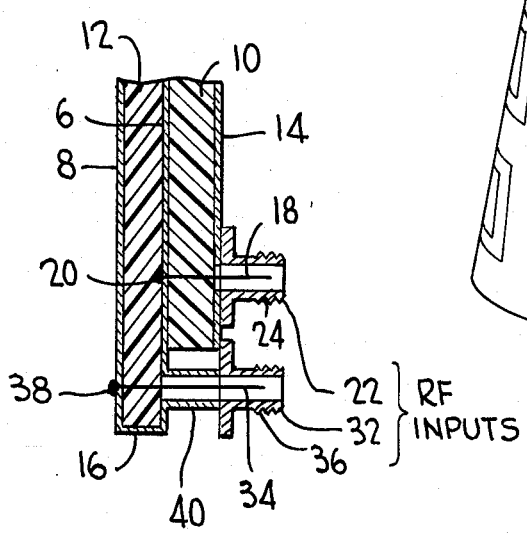

An alternate technique for feeding and mounting this type of antenna is shown in FIG. 2 wherein reference numerals corresponding to those of FIG. 1 represent similar parts. In this embodiment upper radiating element 4 is shifted downward so that the coaxial line 32 feeding this radiating element does not pass through element 2. Instead line 32 couples below element 2 in a manner very similar to FIG. 1. Although feeds 22 and 32 are transposed in FIG. 2, conductive wall 40 which is electrically coupled to outer jacket 36 of coax 32 still acts to short ground plane 14 with radiating element 6. Inner conductor 34 still is electrically coupled to element 8 at a similar impedance matching point on parallel plate 4.

Figure 4:
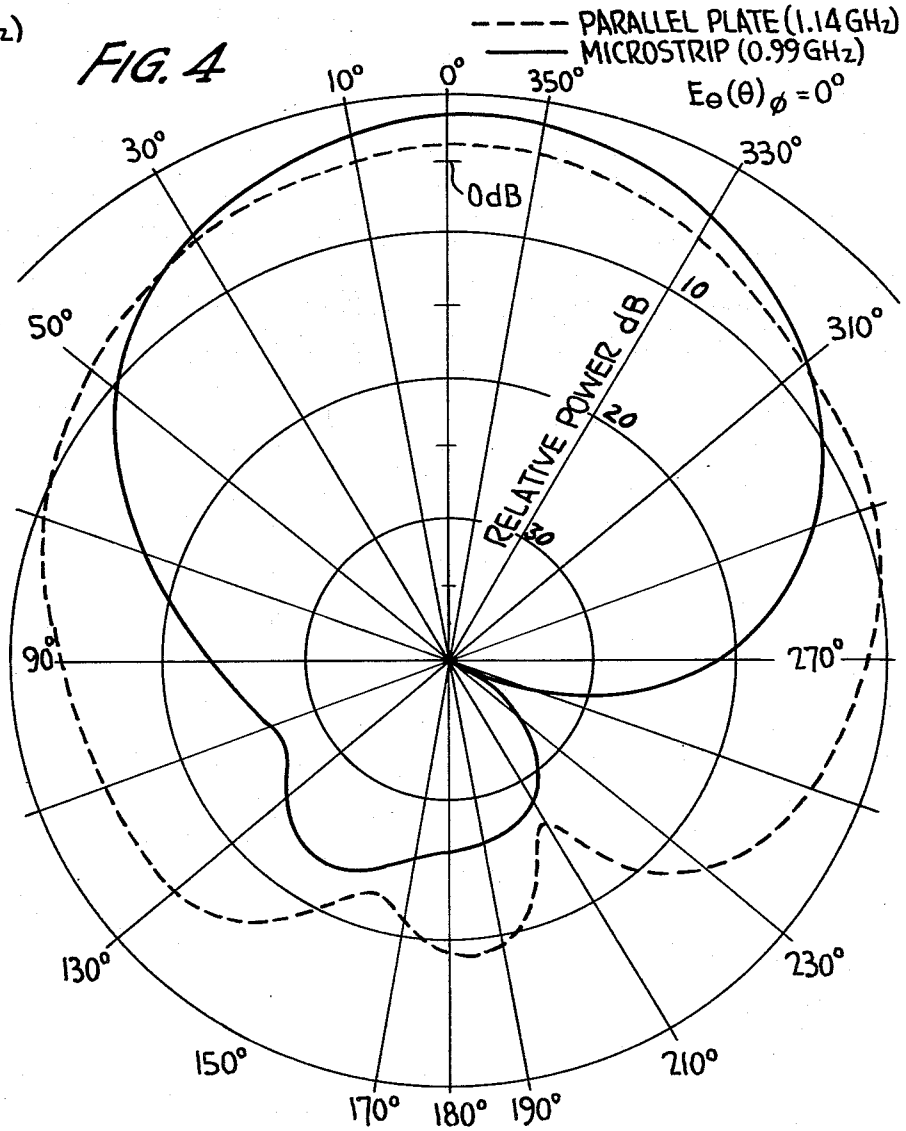
FIG. 4 illustrates graphically the far-field elevation radiation pattern for one embodiment of this invention.
Figure 3:
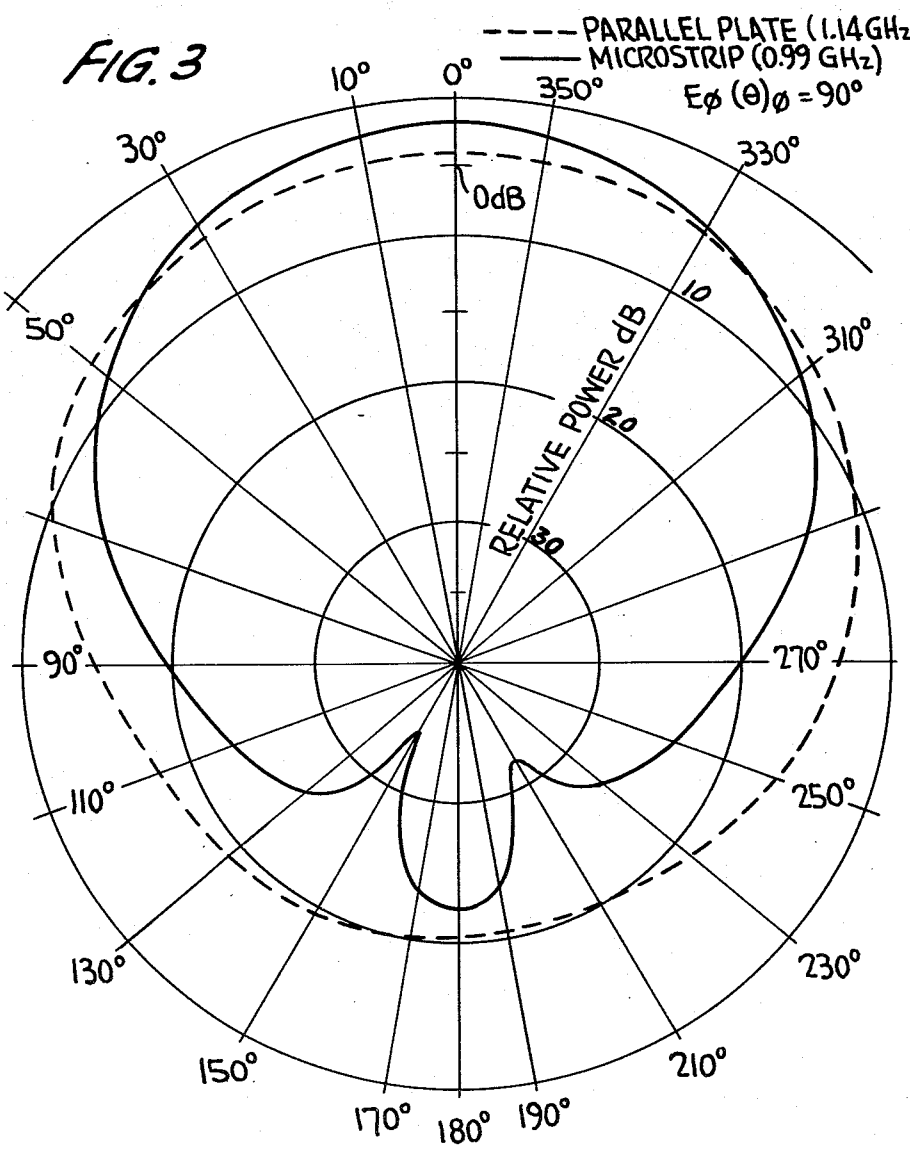
FIG. 3 illustrates graphically the far-field azimuthal radiation pattern for one embodiment of this invention.

The far-field radiation patterns for an antenna designed similarly to the antenna of FIG. 1 are shown in FIGS. 3 and 4. The antenna is basically constructed of copper clad teflon fiberglass laminated board. The larger microstrip radiator is designed to operate at 0.99 GHz and the smaller parallel plate antenna at 1.4 GHz. The pattern for the parallel plate antenna is shown by the hatched lines, and the pattern for the microstrip antenna is shown by the solid lines with FIG. 3 illustrating the azimuthal, patterns and FIG. 4 the orthogonal patterns. These patterns reflect broad radiation coverage, gain, beamwidth, etc. The input VSWR for the same antenna system in each case was at 2.0 to 1.0 or better. A 30 db decoupling between the elements is obtainable.

Figure 5:
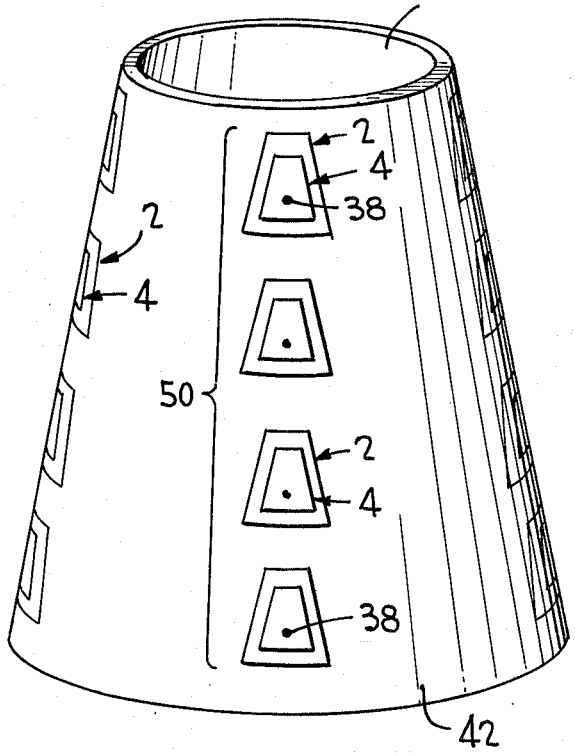
FIG. 5 illustrates schematically the basic flush mounted piggyback antenna utilized as conformal radiating elements on a conical structure or radome.

FIG. 5 illustrates how the flush mounted piggyback antenna may be utilized as conformal radiating elements on a conical structure or radome. Piggyback radiating elements 2 and 4 are mounted on radome structure 42 which is preferably composed of a dielectric material. The radome's inside surface 14 is copper plated and acts as a ground plane for the conformal radiating elements. Conformal linear arrays 50 designed in this manner provide an antenna system which is quite advantageous in missile and projectile applications. It is especially valuable since it eliminates the need of antennas inside the radome for fuzing, guidance, telemetry, and other antenna functions.

This technique therefore provides a unique antenna system by which two antennas can share the same aperture, be flush mounted, compact and yet have good electrical isolation due to the fact that there will be little measurable current flow on the patch where one antenna is placed atop the other. Therefore there is little coupling between the antennas in the system and no deterioration in the performance of either radiator. Of course a variety of communication applications can be envisioned for this system due to its compact profile, good radiation characteristics, and light weight. Any number of these antennas can be placed on any type of radome or similar structure. A dielectric covering the entire system may be utilized for structural integrity and streamlining. The array need not be linear for any type of matrix format can be chosen. Additionally numerous variations and modifications of the present invention are possible in light of the above teachings. The configuration, types of couplings, size, dielectric, and the like can be changed without departing from the spirit and scope of this invention.

What we claim is:

1. A piggyback radiating system which comprises: p1 a ground plane;
   - a first radiating element which is flush mounted above the ground plane;
   - a second radiating element which is flush mounted over the first radiating element in an area where there is minimal current flow;
   - a first coaxial feed means for feeding the first radiating element; and
   - a second coaxial feed means for feeding the second radiating element, the outer conductor of the second feed means shorting the ground plane and the first radiating element, therefore serving as an impedance match to the first radiating element.

2. The system, as set forth in claim 1, wherein the first radiating element has an electrical length of approximately $\lambda/2$ at its operating frequency and the second radiating element has an electrical length of approximately $\lambda/4$ at its operating frequency.

3. The system, as set forth in claim 2, wherein both radiating elements are wedge shaped in the plane parallel to the ground plane.

4. The system, as set forth in claim 1, wherein the first and second radiating elements are microstrip radiators.

5. The system, as set forth in claim 1, wherein the first and second radiating elements are dielectric-loaded parallel plate radiators.

6. The system, as set forth in claim 1, wherein the first radiating element and second radiating elements comprise microstrip and parallel plate radiators.

7. The system, as set forth in claim 1, wherein the second radiating element is a dielectric loaded parallel plate radiator and the first radiating element is a microstrip radiator.

8. The system, as set forth in claim 6, wherein the center conductor of the second feed means is fed to a portion of the second radiating element which is extended over the first radiating element so that the center conductor of the second means need not pass through the first radiating element.

9. The system, as set forth in claim 6, wherein the center conductor of the second feed means is fed completely through the microstrip radiator.

10. The system, as set forth in claim 9, wherein the dual radiators are set in an array.

* * * * *